US005916137A

United States Patent [19]

Hayashi

[11] Patent Number: 5,916,137

[45] Date of Patent: Jun. 29, 1999

[54] METHOD FOR MANUFACTURE OF MAJOR COMPONENTS FOR AN EXHAUST SYSTEM FOR A MOTORCAR

[76] Inventor: Toshiomi Hayashi, 18-7 Ohamachinishi 2-chome, Asaminami-ku, Hiroshima-shi, Hiroshima-ken, Japan

[21] Appl. No.: 08/742,121

[22] Filed: Oct. 31, 1996

[30] Foreign Application Priority Data

Oct. 31, 1995 [JP] Japan ..... 7-283035

[51] Int. Cl.[6] ..... F01N 7/00

[52] U.S. Cl. ..... 60/323

[58] Field of Search ..... 60/323; 29/890.08

[56] References Cited

U.S. PATENT DOCUMENTS 3,727,410 4/1973 Scheitlin et al. ..... 60/323
3,775,979 12/1973 Scheitlin et al. ..... 60/323
4,037,408 7/1977 Ozawa ..... 60/323
4,689,952 9/1987 Arthur et al. ..... 60/323
5,349,817 9/1994 Bekkering ..... 60/323

*Primary Examiner*—Marguerite McMahon
*Attorney, Agent, or Firm*—Lowe Hauptman Gopstein Gilman & Berner

[57] ABSTRACT

An exhaust manifold A that embodies the invention in one preferred form includes a double-wall structure 3 consisting of an inner shell IS and an outer shell OS. The double-wall structure has a substantially straight body portion 1, three branches 16 projecting downward from the body portion 1, and a curved tail portion 15. Each shell comprises half shells 1A and 1B that are mechanically interlocked at their edges 1*c*. Also the branches 16 are mechanically interlocked with a flange coupling 4. In addition, an outlet coupling 5 is mechanically interlocked with the tail portion 15.

6 Claims, 11 Drawing Sheets

METHOD FOR MANUFACTURE OF MAJOR COMPONENTS FOR AN EXHAUST SYSTEM FOR A MOTORCAR

FIELD OF THE INVENTION

This invention relates to the manufacture of major components of an exhaust system for a motorcar, including an exhaust manifold and a casing for a muffler, by pressing and mechanically connecting metal plates.

BACKGROUND OF THE INVENTION

Exhaust manifolds were long manufactured by casting. Thereafter, as needs for energy saving and emission control increased, the conventional manufacturing method has come to be replaced by the pressing and welding of metal pipes and plates, which are lighter in weight and more heat-resistant than castings to manufacture the manifolds. In particular, exhaust manifolds produced by the new method are widely used for sports cars and similar cars equipped with superchargers.

While having the two good points, namely, the lightness of the material in weight and its greater resistance to heat, the new manufacturing method however has the following drawbacks:

(a) The metal to be made into the manifold may be deformed (by welding operation) where it is welded to a pipe and, for this reason, it may be that a flange coupling of small thickness cannot be used.

(b) The new manufacturing method requires a great deal of skill in welding operation.

(c) Exhaust manifolds produced by the new method may have different qualities, particularly due to differences in skill at welding operation.

(d) The heat used for welding operation deteriorates the material for the manifold.

(e) Major requisites for welding operation, including the welding apparatus, electric power, welding electrode, and welding gas, cost much.

(f) Welding operation pollutes its environment.

SUMMARY OF THE INVENTION

Accordingly, it is an object of the invention to provide a method for manufacturing major components of an exhaust system for a motorcar, including an exhaust manifold and a casing for a muffler, without doing welding.

Another object of the invention is to provide a method for manufacturing such components, which comprises pressing and mechanically connecting metal plates.

A still another object of the invention is to provide a method for manufacturing such components, which comprises pressing and mechanically interlocking metal plates.

PREFERRED EMBODIMENTS OF THE INVENTION

Figure 1:
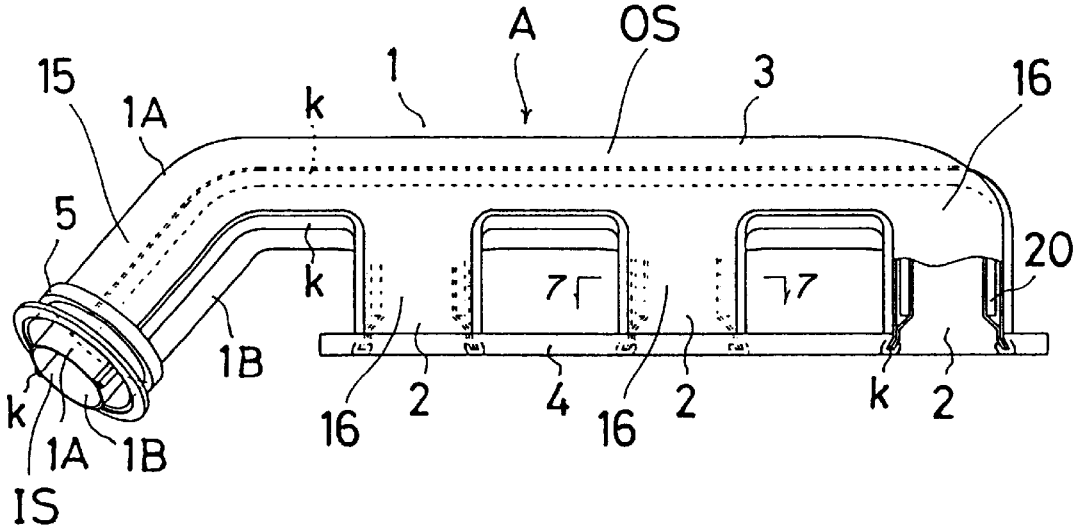
FIG. 1 is a front view of an exhaust manifold A assembled according to the invention.
Figure 7:
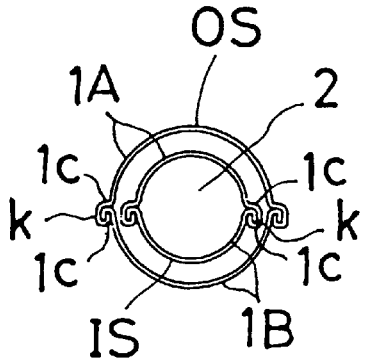
FIG. 7 is a horizontal cross section of the manifold A of FIG. 1 taken on line a—a of FIG. 1.

An exhaust manifold A that embodies the invention in one preferred form will now be described with reference to FIGS. 1 to 8. FIG. 1 is a front view of the exhaust manifold A, and FIG. 7 is a cross section of the manifold A taken on line a—a of FIG. 1. As best shown in FIG. 7, the manifold A includes an inner shell IS and an outer shell OS, both of metal. The reference numeral 3 simply designates a double-wall structure that is made up of the two shells IS and OS.

The double-wall structure 3 has a substantially straight body portion 1, three branches 16 projecting downward from the body portion 1, and a curved tail portion 15.

Figure 8A:
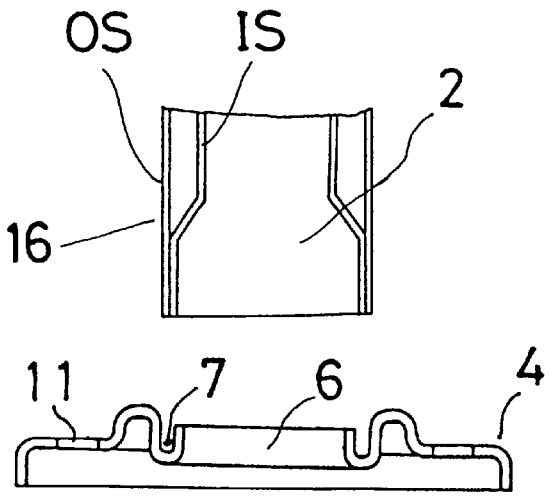
FIGS. 8(*a*), 8(*b*), 8(*c*) illustrate how branches 16 of a double-wall structure 3 of the manifold A of FIG. 1 can be interlocked with a flange coupling 4.
Figure 8B:
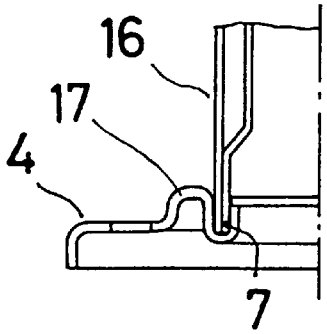
Figure 8C:
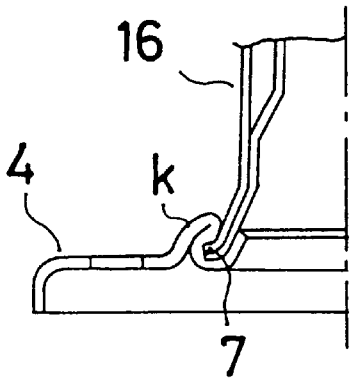

Each branch 16 defines an inlet port 2 therein. A flat flange coupling 4 with a cross section of FIG. 8(*a*) is connected to the lower ends of the branches 16. The coupling 4 is produced by pressing metal. The coupling 4 has three openings 6 that communicate directly with the inlet ports 2. Only one opening 6 is shown in FIG. 8(*a*). An annular groove 7 is formed around the opening 6. As shown in FIG. 8(*b*) and 8(*c*), the lower end of the branch 16 is received in the annular groove 7.

As best shown in FIG. 7, each shell (IS and OS) consists of half shells 1A and 1B.

With either shell, the edges 1*c*, 1*c* of one half shell 1A and the edges 1*c*, 1*c* of the other half shell 1B are driven together such that these edges are mechanically interlocked (FIG. 7). As a result, firm and airtight joints k are made between the two half shells 1A and 1B to provide the whole shell IS or OS. As shown in FIG. 1, a heat-insulating material 20 is disposed between the inner shell IS and the outer shell OS.

A carbon steel containing a large percentage of carbon, such as one selected from the range of SCM 440 to SCM 430 or S45C or S55C, should preferably be used as the metal for the shells.

Figure 2:
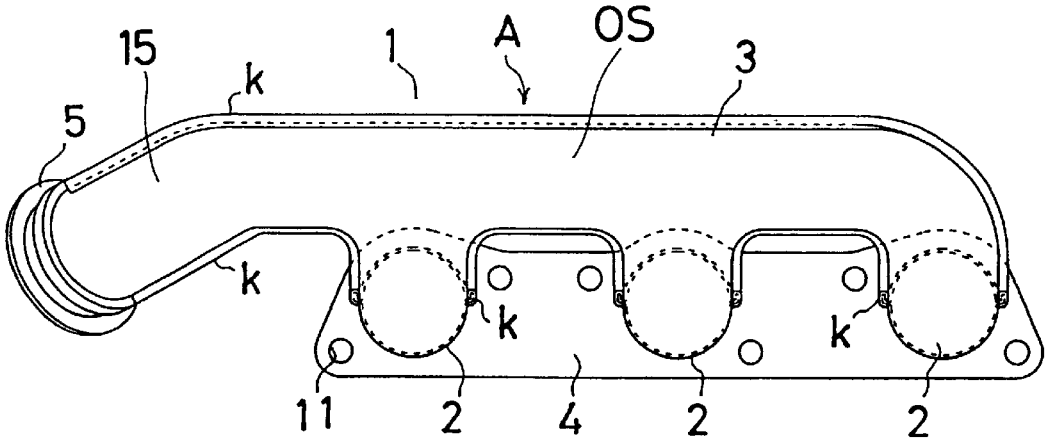
FIG. 2 is a plan view of the manifold of FIG. 1.
Figure 3:
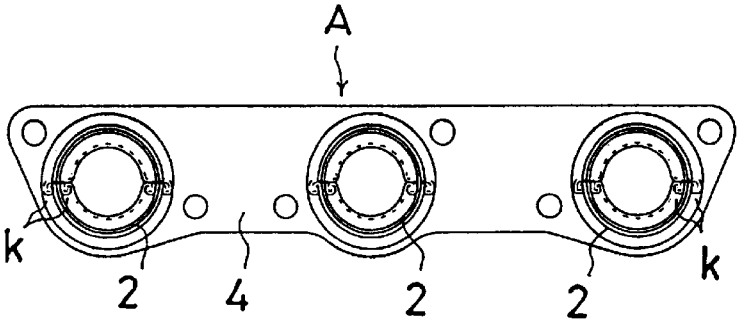
FIG. 3 shows the bottom of the manifold of FIG. 1.

As best shown in FIG. 8(*a*) to 8(*c*), in each branch 16 the inner shell IS has a portion that is in contact with the outer shell OS. As described above, the lower end of the branch 16 is received in the annular groove 7 of the coupling 4, while at the same time the lower end of the branch 16 and a ridge 17 defining the groove 7 are driven together such that the lower end of the branch 16 and the ridge 17 are mechanically interlocked (FIGS. 8(*b*) and 8(*c*)). The branches 16 and the coupling 4 are thus joined together. The coupling 4 has openings 11 that receive bolts (not shown) (FIG. 2).

Figure 4:
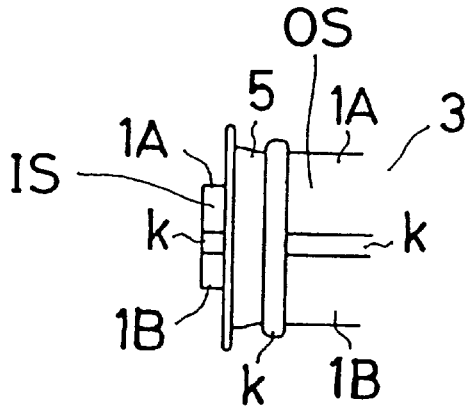
FIG. 4 shows a tail end of the manifold of FIG. 1.
Figure 5:
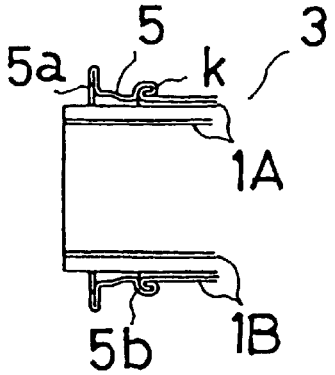
FIG. 5 is a vertical cross section of the tail end of FIG. 4.
Figure 6:
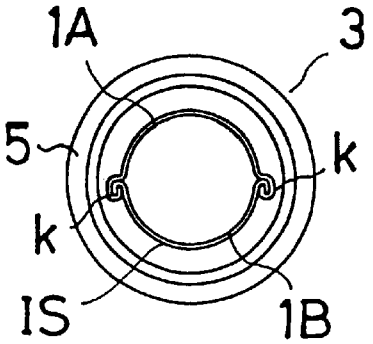
FIG. 6 shows the tail end of FIG. 4 as viewed from the left-hand direction of FIG. 4.

As shown in FIGS. 1 and 4, the tail end of the inner shell IS is projecting more outwardly than the tail end of the outer shell OS. As depicted particularly well in FIGS. 4 and 5, an outlet coupling 5 is joined with the tail end of the outer shell OS. This coupling 5 is also produced by pressing metal. The coupling 5 has two flanges 5*a* and 5*b* (FIG. 5). The flange 5*a* is used to connect the manifold A to a muffler (not shown) or another component that may be used between the manifold A and a muffler, both being not shown, while the flange 5*b* is joined with the tail end of the outer shell OS. That is, as shown in FIG. 5, the flange 5*b* and the tail end of the outer shell OS are driven together such that the flange 5*b* and the tail end of the outer shell OS are mechanically interlocked. The outlet coupling 5 is thus joined with the tail end of the outer shell OS.

The exhaust manifold A can be assembled as follows. First, for the inner shell IS, a metal plate is pressed into a semicylindrical object with branch portions and a tail portion having shapes corresponding to the shapes of the branches 16 and the shape of the curved tail portion 15, respectively. One half shell 1A or 1B is thus obtained. Then, another metal plate is pressed into a similar shape so that a complementary half shell 1A or 1B is obtained. Then the two half shells 1A and 1B are mechanically connected. That is, the edges 1*c*, 1*c* of one half shell 1A are made to abut the edges 1*c*, 1*c* of the other half shell 1B, and as best shown in FIG. 7, those edges are driven together such that those edges are mechanically interlocked. As a result, firm and airtight joints k are made between the two half shells 1A and 1B. The whole inner shell IS is produced in this fashion. Then, the inner shell IS is covered with a suitable heat-insulating material 20 (FIG. 1). Then additional two metal plates are pressed into similar shapes to the half shells 1A and 1B of the inner shell IS but which are larger than those half shells. Then the new two half shells 1A and 1B thus obtained are mechanically connected together, on the heat-insulating material 20, in the same manner as the half shells 1A and 1B of the inner shell IS. As a result, not only is the whole outer shell OS formed on the heat-insulating material 20 but at the same time there is completed a double-wall structure 3 where the two shells IS and OS are joined together with the heat-insulating material 20 between. The double-wall structure 3 as illustrated in FIG. 1 comprises a substantially straight body portion 1, three branches 16 projecting downward from the body portion 1, and a curved tail portion 15. Then, the outlet coupling 5 is connected to the tail end of the outer shell OS. To be more exact, as best shown in FIG. 5, the flange 5*b* of the outlet coupling 5 and the tail end of the outer shell OS are driven together such that the flange 5*b* and the outer shell's tail end are mechanically interlocked. Then, the flange coupling 4 is connected to the double-wall structure 3 in a similar fashion. That is, as shown in FIGS. 8(*a*) and 8(*b*), the lower end of each branch 16 of the double-wall structure 3 is engaged with one annular groove 7 of the coupling 4, and then the branch's lower end and the ridge 17 of the coupling 4 are driven together such that the branch's lower end and the ridge 17 are mechanically interlocked, as shown in FIG. 8(*c*). The coupling 4 is thus joined with the branches 16. In the conditions of FIGS. 8(*a*) and 8(*b*) the enlarged lower end of the inner shell IS is not artificially fastened to the outer shell OS but is only in physical contact with the outer shell.

The exhaust manifold A is thus completed.

If a cast flange coupling of large thickness is used instead of the illustrated flange coupling 4 of metal, grooves similar to the illustrated grooves 7 may be formed by cutting the casting.

Figure 9:
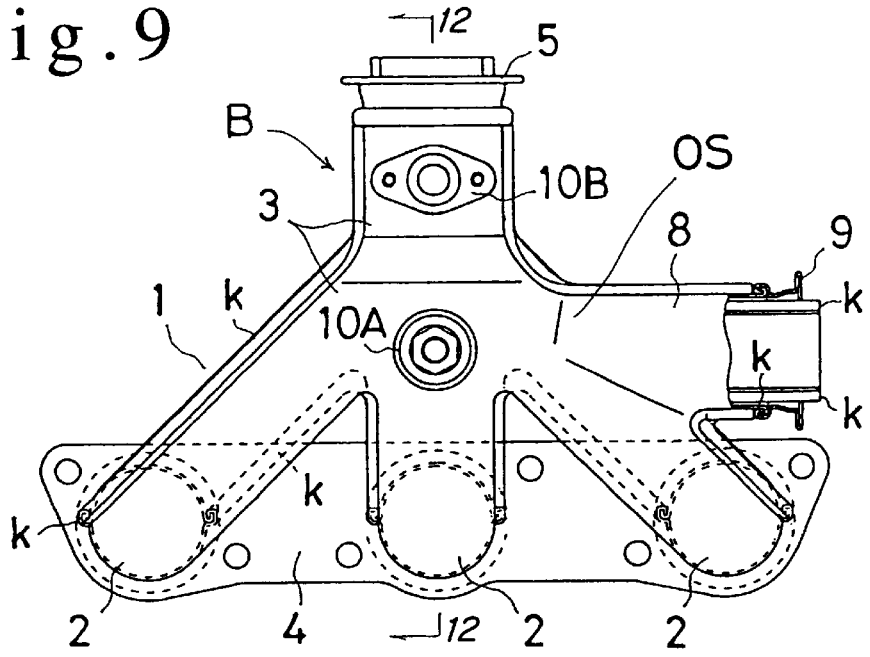
FIG. 9 is a plan view of another exhaust manifold B assembled according to the invention.
Figure 10:
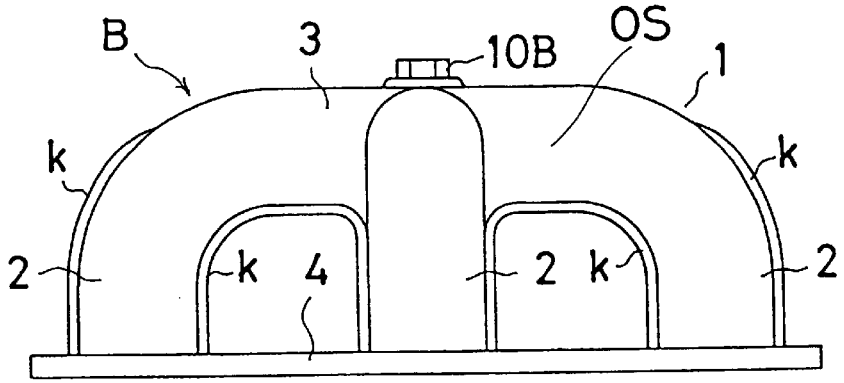
FIG. 10 is a front view of the manifold of FIG. 9.
Figure 11:
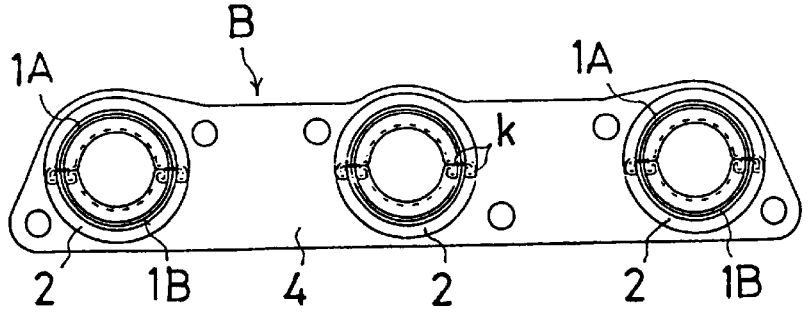
FIG. 11 shows the bottom of the manifold of FIG. 9.
Figure 12:
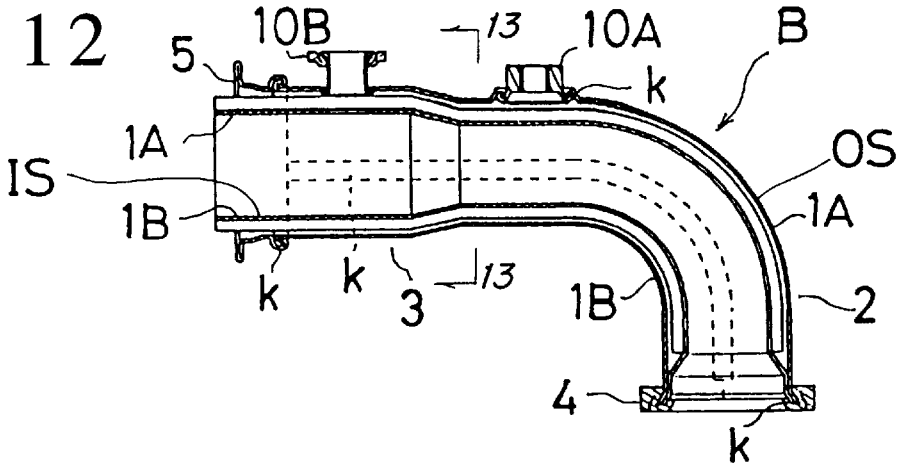
FIG. 12 is a vertical cross section of the manifold of FIG. 9 taken on line 12—12 of FIG. 9.
Figure 13:
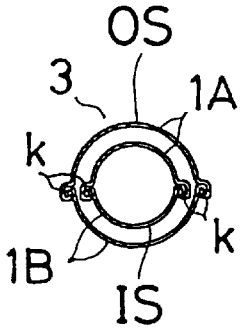
FIG. 13 is a cross section taken on line 13—13 of FIG. 12.
Figure 14:
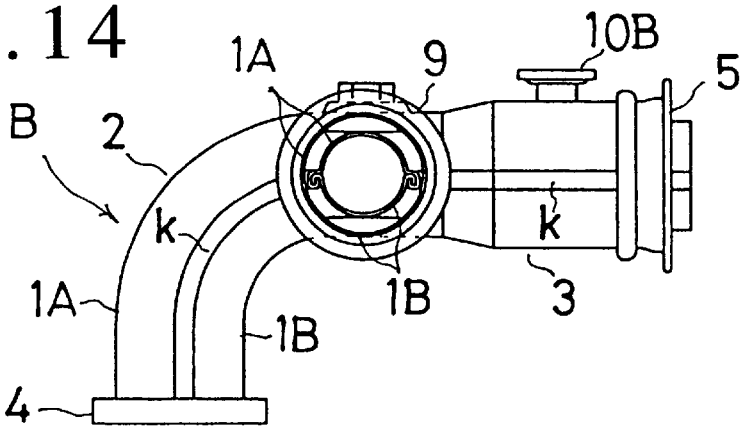
FIG. 14 shows one side of the manifold of FIG. 1 as viewed from the right-hand direction of FIG. 9.
Figure 15:
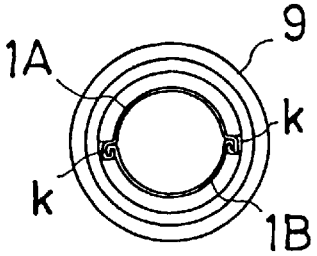
FIG. 15 shows the central part of the construction of FIG. 14.

FIGS. 9 to 11 illustrate another embodiment of the invention. That is, another exhaust manifold B assembled according to the invention is shown in FIGS. 9 to 11. This manifold is used for an engine with a turbo charger. FIG. 9 is a plan view of the manifold B. FIG. 10 is a front view of the manifold of FIG. 9. FIG. 12 is a vertical cross section of the manifold of FIG. 9 taken on line b—b of FIG. 9, and FIG. 13 is a cross section of the same manifold B taken on line c—c of FIG. 12. As best shown in FIGS. 12 and 13, like the first exhaust manifold A, the second exhaust manifold B also comprises an inner shell IS and an outer shell OS, each being made up of two half shells 1A and 1B that are mechanically interlocked with each other. As with the first embodiment, each half shell is produced by pressing metal. Exhaust gas entering the manifold B through inlet ports 2 flows out from an outlet coupling 5 into an exhaust turbine (not shown) that is located between the manifold and a muffler (not shown). The second manifold B also has an additional outlet port 8 for controlling exhaust pressure, which communicates with a waste gate valve (not shown). An outlet coupling 9 is joined with the outlet port 8. However, an exhaust manifold similar to this second manifold B can be produced according to the invention if the outlet port 8 is omitted. The manifold B also has couplings 10A and 10B that are mechanically interlocked with the outer shell OS. A temperature sensor or or similar device can be connected to the couplings 10A and 10B.

Figure 16:
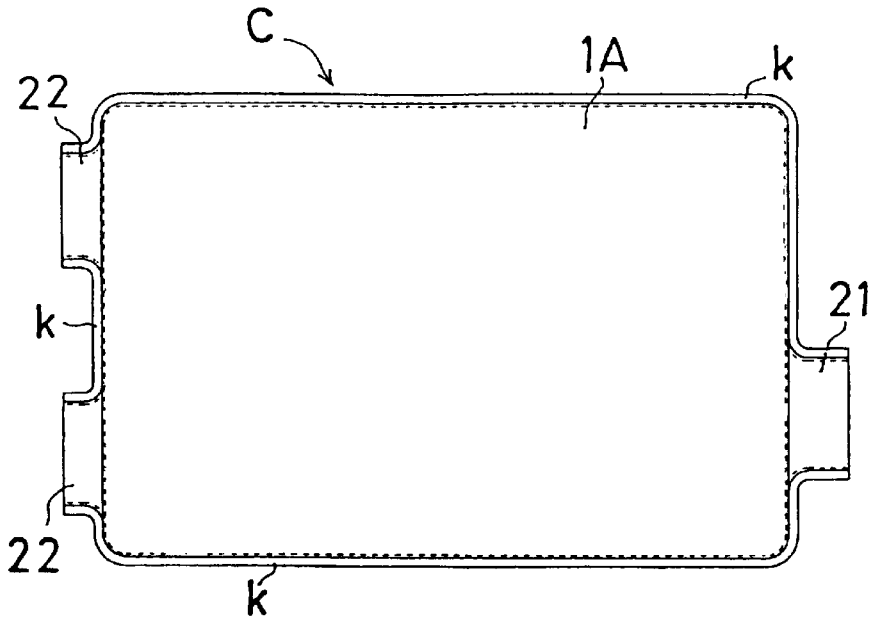
FIG. 16 is a plan view of a casing C for a muffler that is assembled according to the invention.
Figure 17:
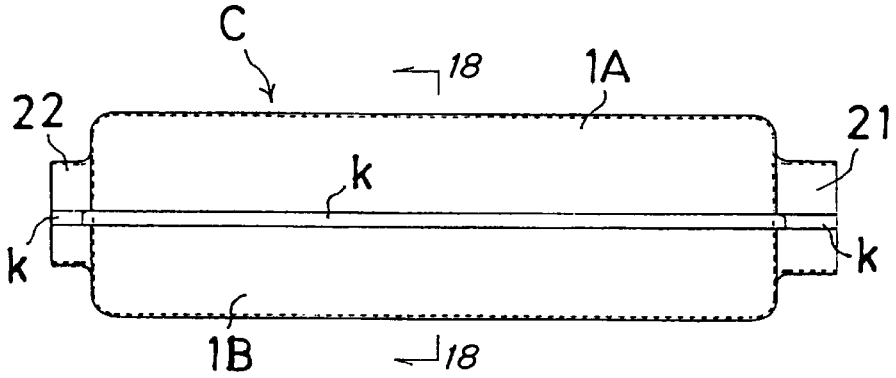
FIG. 17 is a front view of the casing C of FIG. 16.
Figure 18:
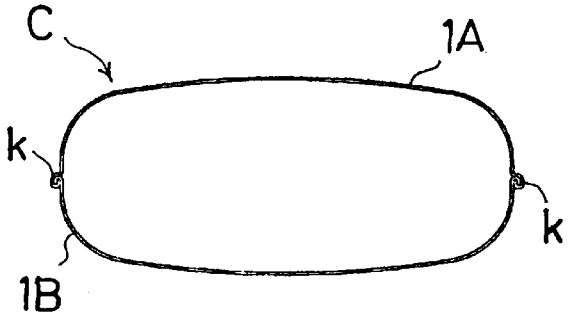
FIG. 18 is a vertical cross section of the construction of FIG. 17 taken on line 18—18 of FIG. 17.
Figure 19:
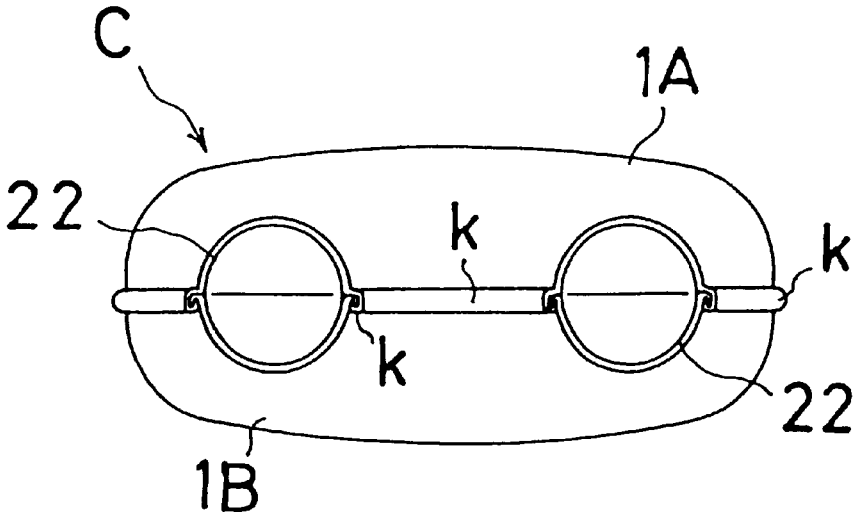
FIG. 19 shows the left-hand side of the construction of FIG. 17.
Figure 20:
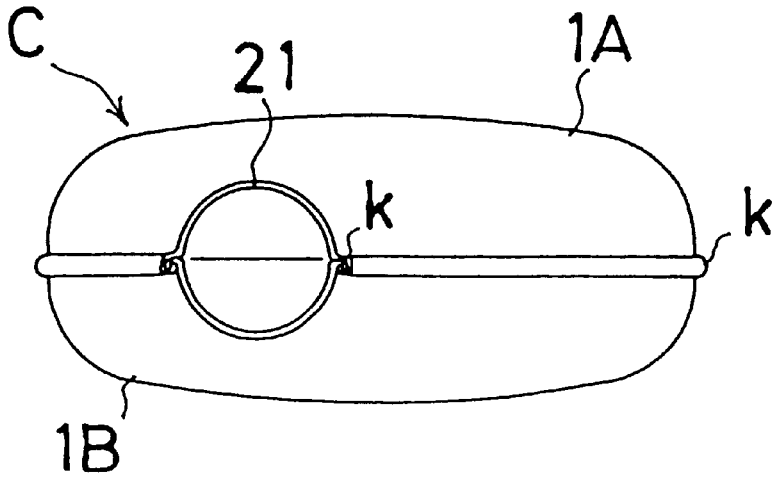
FIG. 20 shows the right-hand side of the construction of FIG. 17.
Figure 21:
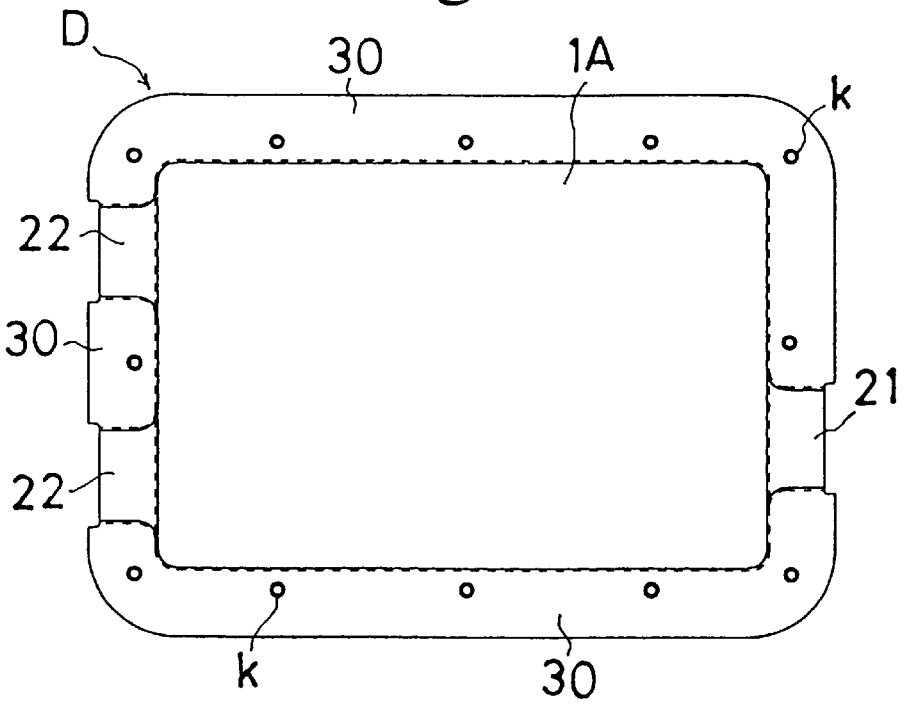
FIG. 21 is a plan view of another casing D for a muffler that is assembled according to the invention.
Figure 22:
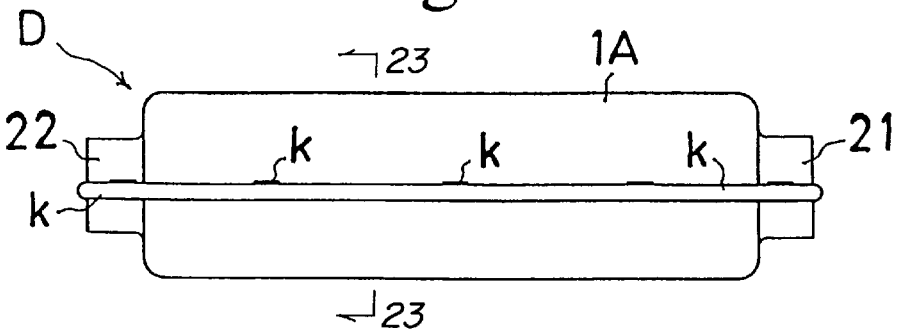
FIG. 22 is a front view of the casing of FIG. 21.
Figure 23:
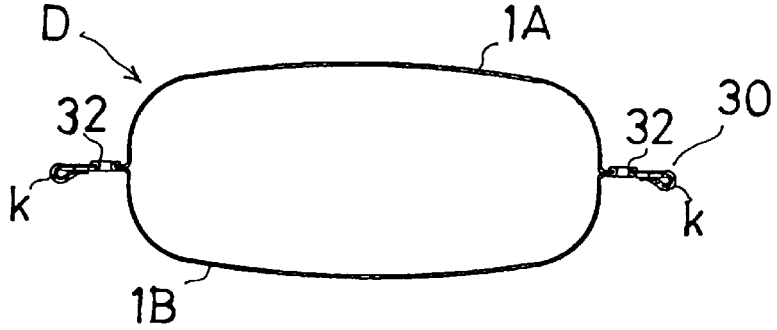
FIG. 23 is a cross section taken on line 13—13 of FIG. 22.
Figure 24:
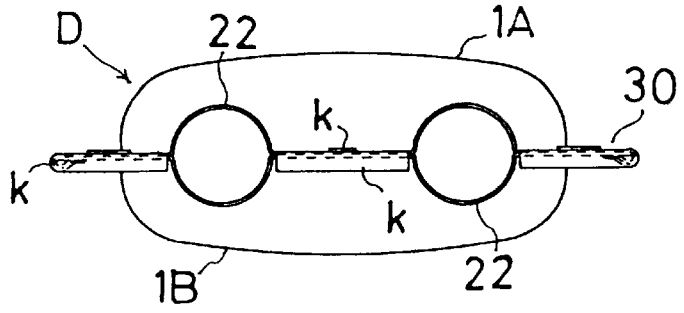
FIG. 24 shows the left-hand side of the construction of FIG. 22.
Figure 25:
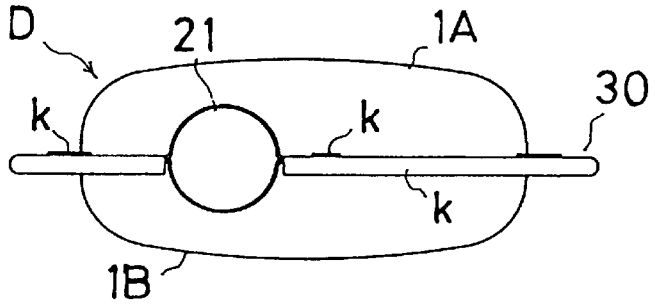
FIG. 25 shows the right-hand side of the construction of FIG. 22.

A third embodiment of the invention is shown in FIGS. 16 to 20. The third embodiment is not an exhaust manifold but a casing C for a muffler. FIG. 16 is a plan view of the casing C, and FIG. 17 is a front view of the casing C of FIG. 16. FIG. 18 is a vertical cross section of the casing C taken on line d—d of FIG. 17. As illustrated, the casing C comprises an upper half shell 1A and a lower half shell 1B. As with the first and second embodiments, each half shell is produced by pressing metal plates, and the two half shells 1A and 1B are mechanically interlocked with each other at their edges k. The whole shell C has one inlet port 21 on one side that project from its body, and has two outlet ports 22 on the opposed side that also project from its body. As is best shown in FIGS. 19 and 20, the inlet port 21 is formed of a half circle of the upper half shell 1A and a complementary half circle of the lower half shell 1B while each outlet port 22 is also formed of a half circle of the upper half shell 1A and a complementary half circle of the lower half shell 1B. The three half circles of the upper half shell 1A are formed integrally with its body when the upper half shell 1A is produced (by pressing a metal plate). This is also the case with the three half circles of the lower half shell 1B. As illustrated, the upper and lower half circles, like the bodies of the half shells, are mechanically interlocked with each other at their edges.

Figure 26:
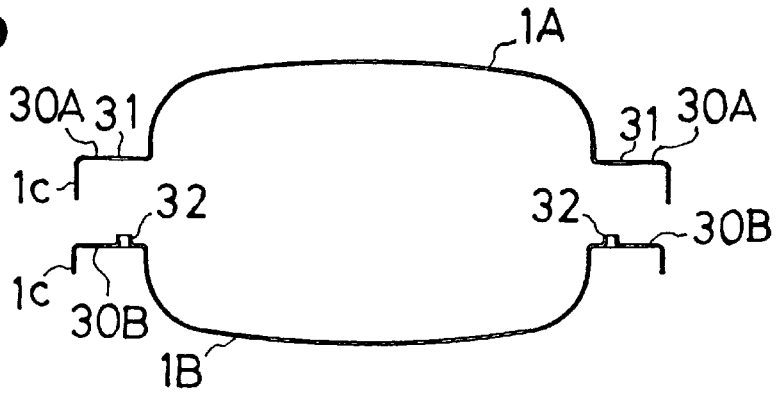
FIG. 26 illustrates two half shells 1A and 1B of the casing of FIG. 21.
Figure 27:
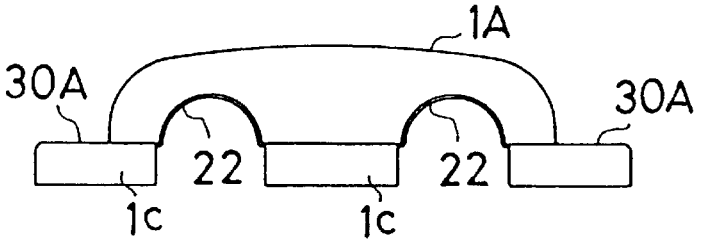
FIG. 27 shows the left-hand side of the upper half of the construction D of FIG. 22.
Figure 28A:
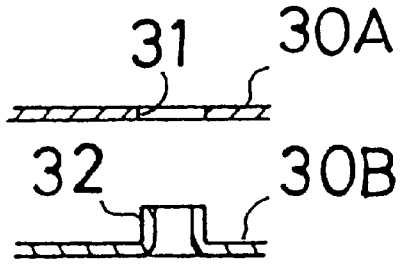
FIGS. 28(*a*), 28(*b*), 28(*c*), and 28(*d*) illustrate how flange portions 30A and 30B can be preliminarily interlocked; and In FIGS. 29(*a*)–(*e*) the flange portions 30A and 30B are pressed together to firmly join the half shells 1A and 1B of FIG. 26.
Figure 28B:
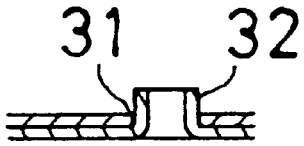
Figure 28C:
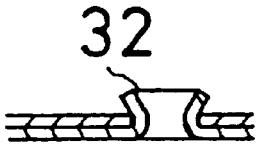
Figure 28D:
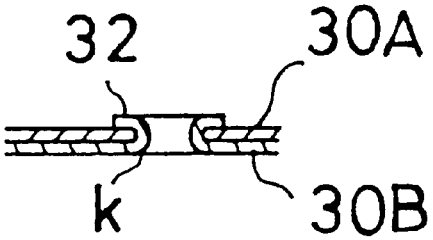
Figure 29A:
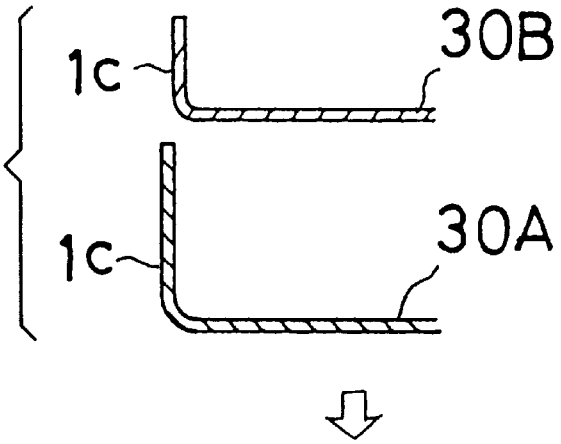
Figure 29B:
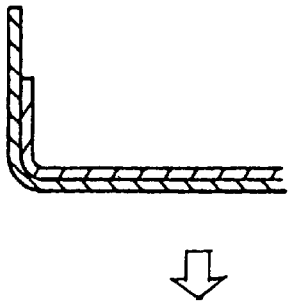
Figure 29C:
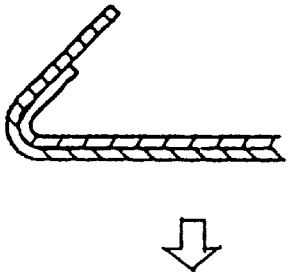
Figure 29D:
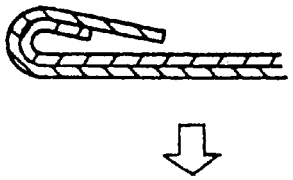
Figure 29E:
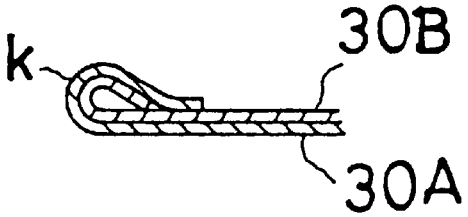

A fourth embodiment of the invention is shown in FIGS. 21 to 29. The fourth embodiment is also a casing D for a muffler, but this casing D differs from the casing C in that the casing D has a flange 30 projecting outwardly from the body of the casing D. This flange 30 may serve as a heat-radiating fin, a reinforcing rib and/or a bracket for connecting the muffler to another object. Accordingly, as best shown in FIG. 26, the casing D comprises half shells 1A and 1B having flange portions 30A and 30B, respectively. As clearly illustrated, the flange portions 30A and 30B are angled to provide vertical edges 1*c*, 1*c*. Also, the flange portion 30A of the half shell 1A is provided with plural openings 31. Only two of the openings 31 are shown in FIG. 26, and only one opening 31 is shown in FIGS. 28(*a*) to 28(*d*). The flange portion 30B of the other half shell 1B has plural projections 32 in positions corresponding to those of the openings 31. Each projection 32 has a cylindrical shape. The projections 32 are formed integrally with the rest of the half shell 30B by pressing a metal plate.

The casing D can be assembled as follows: First, as shown in FIGS. 28(*a*) and 28(*b*), the two half shells 1B and 1A are engaged with each other such that the projections 32 are received in the respective openings 31. Then, as shown in FIGS. 28(*c*) and 28(*d*), the projections 32 are pressed against the flange portion 30A of the half shell 1A. As a result, the two flange portions 30A and 30B are mechanically interlocked. Then, as shown in FIG. 29, the vertical edges 1*c*, 1*c* of the flange portions 30A and 30B are pressed together inwardly until the edge 1*c* of the flange portion 30A completely embraces the edge 1*c* of the other flange portion 30B. The half shells 1A and 1B are thus firmly joined together to provide the casing D.

It will be appreciated that the half shells 1A and 1B do not move relatively to each other when the edges 1*c*, 1*c* of the flange portions 30A and 30B are pressed together, because the two flange portions are preliminarily interlocked with each other as described above.

Thus, according to the invention, it is possible to manufacture major components of an exhaust system, such as an exhaust manifold and a casing of muffler, without doing welding at all. All one has to do is to press metals into necessary shapes and mechanically connect them together.

What is claimed is:

1. A major component of an exhaust system of a motorcar, including at least one shell having two half shells (1A) and (1B) mechanically interlocked with each other at edges thereof, said major component being an exhaust manifold (A) comprising a double-wall structure (3) including an inner shell (IS) and an outer shell (OS) which each comprises respective half shells (1A) and (1B) interlocked with each other at respective edges (1*c*) thereof, said exhaust manifold also including a flange coupling (4) mechanically interlocked with branches (16) of said double-wall structure (3) and an outlet coupling (5) mechanically interlocked with a tail end of said outer shell (OS), wherein each said branch (16) has a lower end received in an annular groove (7) and interlocked mechanically with a ridge (17) that defines said groove (7).

2. A major component of an exhaust system of a motorcar in accordance with claim 1 wherein said flange coupling (4) has a surface including a plurality of annular grooves (7) therein, and each said branch (16) is interlocked mechanically with said flange coupling (4) in one of said grooves (7).

3. A major component of an exhaust system of a motorcar in accordance with claim 1 wherein said flange coupling (4) has a surface including a plurality of ridges (17) therein, and each said branch (16) is interlocked mechanically with said flange coupling (4) by one of said ridges (17).

4. An exhaust manifold comprising:

(i) a double-wall structure (3) including an inner shell (IS) and an outer shell (OS), each of which includes half shells (1A) and (1B), (ii) a flange coupling (4) mechanically interlocked with branches (16) of said double-wall structure (3), and (iii) an outlet coupling (5) mechanically interlocked with a tail end of said outer shell (OS), said exhaust manifold being characterized in that said half shells (1A) and (1B) are mechanically interlocked with each other to provide at least one of said inner shell and said outer shell, wherein each of said branches (16) has a lower end received in an annular groove (7) defined by a ridge (17) and interlocked mechanically with said ridge (17) defining said groove (7).

5. An exhaust manifold in accordance with claim 4 wherein said flange coupling (4) has a surface including a plurality of annular grooves (7) therein, and each said branch (16) is interlocked mechanically with said flange coupling (4) in one of said grooves (7).

6. An exhaust manifold in accordance with claim 4 wherein said flange coupling (4) has a surface including a plurality of ridges (17) therein, and each said branch (16) is interlocked mechanically with said flange coupling (4) by one of said ridges (17).

* * * * *